United States Patent [19]

Kratcoski et al.

[11] 3,982,094

[45] Sept. 21, 1976

[54] APPARATUS FOR FIXING TONER IMAGES

[75] Inventors: Francis L. Kratcoski, Lincolnshire; William Brahos, Chicago, both of Ill.

[73] Assignee: Oce-van der Grinten N.V., Venlo, Netherlands

[22] Filed: Jan. 2, 1975

[21] Appl. No.: 538,038

[52] U.S. Cl. ..... 219/216

[51] Int. Cl.[2] ..... H05B 1/00; G03G 15/20

[58] Field of Search ..... 219/216, 388, 469–471; 432/227, 230, 59; 100/93 RP; 355/9, 3

[56] References Cited

UNITED STATES PATENTS

| | | | |
|---|---|---|---|
| 2,038,607 | 4/1936 | Sauer | 219/470 X |
| 3,313,913 | 4/1967 | Limberger | 219/216 |
| 3,359,404 | 12/1967 | Limberger | 219/470 X |
| 3,437,032 | 4/1969 | Manghirmalani et al. | 219/469 X |
| 3,505,497 | 4/1970 | Lawes et al. | 219/216 |

*Primary Examiner*—C. L. Albritton
*Attorney, Agent, or Firm*—Albert C. Johnston

[57] ABSTRACT

Images of fusible toner particles on flexible sheet material, such as applied to paper sheets in electrostatic photocopying machines, are fixed to the material by feeding it through a heating zone in which the particles are softened without fusing them and then passing the material through the nip between smooth rigid pressure roller surfaces which are constantly pressed together under a force sufficiently great to join the heated toner particles superficially one to another and to the sheet structure without forming them into brittle resinous films. An apparatus for carrying out the fixing comprises a set of smooth rigid feed rollers constantly pressed together, preferably by structures like those used for the pressure rollers, under a selected pressure suited for advancing the material into and through a radiant heating zone at a constant speed and thence into the nip of the pressure rollers which are driven at the same peripheral speed.

5 Claims, 4 Drawing Figures

APPARATUS FOR FIXING TONER IMAGES

This invention relates to a process and apparatus for fixing toner images on flexible sheet material such as paper.

The invention is useful for fixing images made with any of a wide variety of fusible toner particles on any of a variety of flexible sheet materials. For instance, it may be employed for fixing toner images formed on plain paper copy sheets by transfer from a photoconductive imaging medium, as in indirect electrophotography, or for fixing the images formed by applying developing powder to photoconductive paper, such as paper coated with a photoconductive layer of zinc oxide in a binder, in direct electrophotographic copying presses. Further, the toner may be, for instance, a so-called "one component" developing powder such as that described in a copending U. S. patent application Ser. No. 366,845 filed Jan. 4, 1973, the particles of which typically have sizes of between 10 and 40 microns and comprise bodies, or cores, composed predominantly of thermoplastic resin with extremely fine pigment particles, such as carbon black particles, dispersed homogeneously in the resin or, preferably, coated on and partially embedded in the surfaces of the cores. A developing apparatus useful for applying such a powder is disclosed, for instance, in a copending U.S. patent application Ser. No. 483,319 filed June 26, 1974.

It is well known that images of fusible toner particles may be fixed to paper and other supports either by heating them until the particles fuse together and to the support or by subjecting them to high pressure. See Dessaur and Clark, "Xerography and Related Processes" (The Focal Press, 1965), pp. 398–403. Some ways of utilizing heat or pressure, or both, for fixing such images are disclosed in U.S. Pat. Nos. 2,681,473, 3,452,181 and 3,566,076 and German Pat. No. 1,043,810.

In commercial electrostatic copying machines, fusing heat alone or pressure alone is usually employed for fixing the toner images. Proposals to fix them by heat and pressure applied simultaneously through heated pressure rollers involve problems of controlling critically related conditions of time, temperature and pressure; also, problems from offsetting of the toner onto roller surfaces. When images of a "one-component" developing powder above mentioned are fixed by heating to fusion, the fixed images have a dull surface appearance and tend to form brittle films that will easily break off the support sheet. When they are fixed by pressure only, they acquire a shiny surface appearance and again tend to form brittle films that will easily break off the support sheet.

The principal object of the present invention is to provide a process and an apparatus for fixing fusible toner images on flexible sheet material, whereby the particles forming the image elements are superficially joined together and to the surface structure of the sheet material so as to give durably adherent images having a good surface appearance, without forming coalesced films that would easily crack and flake off the support.

Another object of the invention is to provide a process and an apparatus which are especially advantageous for fixing toner images composed of a "one-component" developing powder applied to the sheet material.

A further object is to provide a fixing apparatus that is readily adaptable to provide the conditions of operation required for fixing images of fusible toner particles having any of a variety of compositions on flexible copy material of any of various kinds.

According to the present invention, a flexible sheet material having an image of fusible toner particles thereon, such as the powder image applied to photoconductive paper by the developing system of a direct electrophotographic copying machine or the powder image applied by transfer to plain paper in an indirect electrophotographic copying machine, is fed at a substantially constant speed into and through a heating zone in which, as the material is passing therethrough, the toner particles forming the image are heated to an extent sufficient to soften them but insufficient to fuse them. Then, as the material passes away from the heating zone, it is engaged and advanced between coengaging smooth rigid pressure roller surfaces which are pressed together and moved together at the feeding speed of the material, between which surfaces the material is compacted under a force sufficiently great to join the heated toner particles superficially to one another and to the surface structure of the supporting material by pressure.

The heating of the toner particles in the heating zone is effected advantageously by passing the material, preferably with its image side facing up, through a field of heat radiation emanating from a radiant heating source located in the space between the pressure roller surfaces and the means by which the material is fed through the heating zone. The heat so applied by radiation quickly penetrates throughout the bodies of the toner particles yet is readily controlled in relation to the time of travel of the material through the heating zone so as to effect the required softening of the particles without causing them to fuse or coalesce.

The ensuing compacting of the softened toner particles on the material under the pressure applied evenly by the moving rigid pressure roller surfaces causes the particles to unite superficially one to another and to the surface structure of the material. The pressure so applied is readily regulated so that the thermoplastic resin contents of contiguous toner particles are not melted or fused together into films that would tend to crack and flake off the material.

It has been found that toner images made of a "one-component" developing powder applied to photoconductive paper can be fixed advantageously according to the invention by subjecting them in the heat-softened condition to the pressure produced between the pressure roller surfaces by holding one of these surfaces constantly pressed at each end thereof against the other of them under a force of about 75 to 100 pounds per inch of length of the nip between these surfaces.

The fixing apparatus provided according to the invention comprises walls which define a heating zone between them, means for feeding the sheet material with the image thereon into and through the heating zone at a substantially constant speed, means in that zone for heating the toner particles to an extent sufficient to soften them but insufficient to fuse them as the material is being passed through the heating zone by the feeding means, and two pressure rollers having coengaging smooth rigid peripheral surfaces which are pressed and rotated together for engaging, compacting and advancing the material between these surfaces as the material passes away from the heating zones. The pressure rollers are rotated together by suitable drive transmission means at a peripheral speed equal to the speed of feeding of the material into the heating zone, and means are provided for pressing their rigid peripheral surfaces together under a force sufficiently great to join the heated toner particles superficially to one another and to the surface structure of the sheet material as the material is advanced away from the heating zone between these surfaces.

The smoothness and rigidity, or incompressibility, required for the coengaging pressure roller surfaces may be provided advantageously by forming each of these surfaces of polished hardened steel, such as a quench-hardened carburizing steel tempered to a hardness suitable for polishing its surface.

The force appropriate for fixing the softened toner particles by pressure between the pressure roller surfaces can be selected and applied by means of adjustably settable pressure applying structures acting on anti-friction bearings surrounding journals at the ends of one of the pressure rollers, these structures including rigid pressure distributing blocks and confined bodies of elastomeric material which are pressed constantly under a selected force against opposite end portions of each block.

The means for feeding the sheet material into the heating zone may have any of a variety of forms suitable for engaging and advancing a flexible copy sheet at a constant speed. Advantageously, however, this means also comprises two rollers having coengaging smooth rigid peripheral surfaces, together with means for rotating them at a constant speed and means for constantly pressing their surfaces together under a selected force. The feed rollers thus may have the same construction as the pressure rollers and may be pressed together by pressure applying structures corresponding those of the pressure rollers, though the force to be applied between them ordinarily is far less than that applied between the pressure rollers.

The bearings of all the rollers and their respective pressure applying structures are seated in recesses formed in upright end frames of the apparatus at opposite sides of the path of travel of the sheet material through the apparatus. These frames support the two sets of rollers each with one of its rollers disposed over and pressing down against the other, and they border a space between the roller sets in which the heating zone is defined between a substantially horizontal guide plate and a roof partition spaced above this guide plate. The sheet material passing between the feed rollers slides image-side-up over the guide plate to the nip of the pressure rollers, being thus passed beneath a radiant heating device located in the space between the guide plate and the roof partition. That partition is made with a heat reflective lower surface that reflects radiation incident thereto back toward the guide plate.

The above-mentioned and other objects, features and advantages of the invention will be further evident from the following detailed description and the accompanying drawings of a preferred embodiment of the invention. In the drawings.

In the illustrated embodiment, the parts of the fixing apparatus are mounted on and between end frames 1 and 2 which are connected together by rods 3 spacing them apart by a distance somewhat greater than the width of the sheet material. This material typically is a paper copy sheet S bearing an image of fusible toner particles previously applied to one side of the sheet at a developing or a transfer station of an electrostatic photocopying machine.

Figure 1:
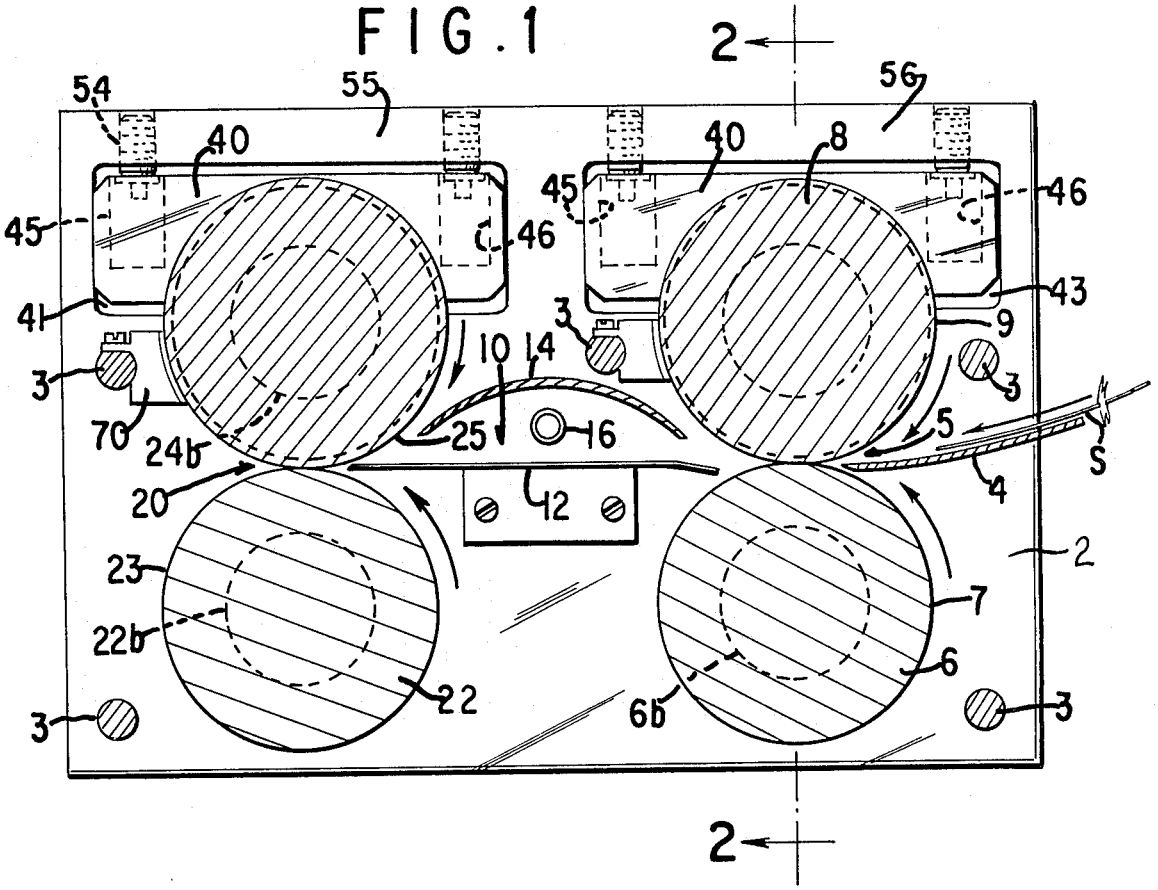
FIG. 1 is a sectional view of the apparatus taken on a medial vertical longitudinal plane.

The sheet material with the toner image thereon enters the apparatus by being moved along its own plane, image-side-up, over a sloped guide plate 4 mounted between the end frames. The plate 4 guides the material into the nip at 5 between the coengaging peripheral surfaces 7 and 9 of two sheet feeding rollers 6 and 8 which are rotated together at a substantially constant speed in the direction of the arrows (FIG. 1). Each of these rollers in the present embodiment has a true cylindrical body of hardened steel presenting a hard peripheral surface that is polished so as to be completely smooth and even, as well as incompressible, over the length of the nip 5. Each roller may be composed, for instance, of a carburizing steel that is polished after having been quench hardened in oil and surface tempered to a hardness of about 58–62 on the Rockwell C scale.

The feed rollers 6 and 8 are pressed and moved together so as to engage each entering sheet in their nip and advance the sheet at a constant speed into and through a heating zone 10. The effectiveness of their engagement with the sheet may be enhanced and wrinkling of the sheet avoided by setting the axis of one roller at a slight inclination in the horizontal direction across the axis of the other roller, so that, for example, the axes are offset by a distance of about 0.1 inch at the end bearings of the rollers more or less, depending upon the magnitude of the pressure on the rollers and their elastic deflection under the pressure.

The heating zone 10 is bordered at its opposite ends by the frames 1 and 2 and is defined more particularly by a substantially horizontal guide plate 12 and a roof partition 14 spaced above plate 12. The guide plate 12 extends from a location just beyond the nip 5 of the feed rollers to a location near the nip 20 of two pressure rollers 22 and 24, so that the sheet being advanced by the feed rollers slides over this plate through the heating zone to the pressure rollers. While being so moved, the sheet passes through the field of heat radiation from a radiant energy source 16, or infrared radiator, disposed over and across the sheet path in the space between plate 12 and partition 14.

Plate 12 preferably is a stainless steel plate having a coating of an anti-friction substance, such as "Teflon" polytetrafluoroethylene, to aid sliding of the material. The roof partition 14 is made with a heat-reflective lower surface that reflects incident radiation back toward the guide plate 12. Its upper side may be made heat dissipating, as by being provided with cooling fins. The intensity of the heating in zone 10 is so related to the time of travel of the sheet through this zone that the toner particles on the sheet are softened but are not melted or fused together by the heating.

The pressure rollers 22 and 24 are rotated together in the direction of the arrows (FIG. 1) at a peripheral speed corresponding to that of the feed rollers. Each pressure roller, like each feed roller, has a true cylindrical body of hardened steel presenting a hard peripheral surface 23 or 25 that is polished so as to be completely smooth and even, as well as incompressible, over the whole length of the nip 20. These rollers are pressed and moved together so that they will engage and advance each sheet between them as the sheet passes away from the heating zone 10, and a force of selected high magnitude is applied for pressing them together. This force is sufficiently great that, as the sheet with the toner image thereon is compacted and compressed between the smooth hard surfaces 23 and 25, the heat-softened particles forming the image are joined superficially to one another and to the surface structure of the sheet by the pressure maintained in the nip 20. On the other hand, the force applied is kept sufficiently limited to avoid damaging or objectionably calendering the sheet material and to avoid forming the toner particles into brittle resinous films.

The effectiveness of the engagement of the pressure rollers with the sheet material may be enhanced, as in the case of the feed rollers by slightly inclined axis of one of these rollers across that of the other in the horizontal direction so that, for example, the axes are offset by a distance of about 0.1 to 0.15 inch at the roller bearings.

In the present embodiment, structures of the same form and mode of operation are provided for selecting and applying the pressure required in the nip 5 between the feed rollers and the much higher pressure required in the nip 20 between the pressure rollers. These structures are shown in part in FIG. 1 and more particularly in FIGS. 2 and 3 of the drawings.

Figure 3:
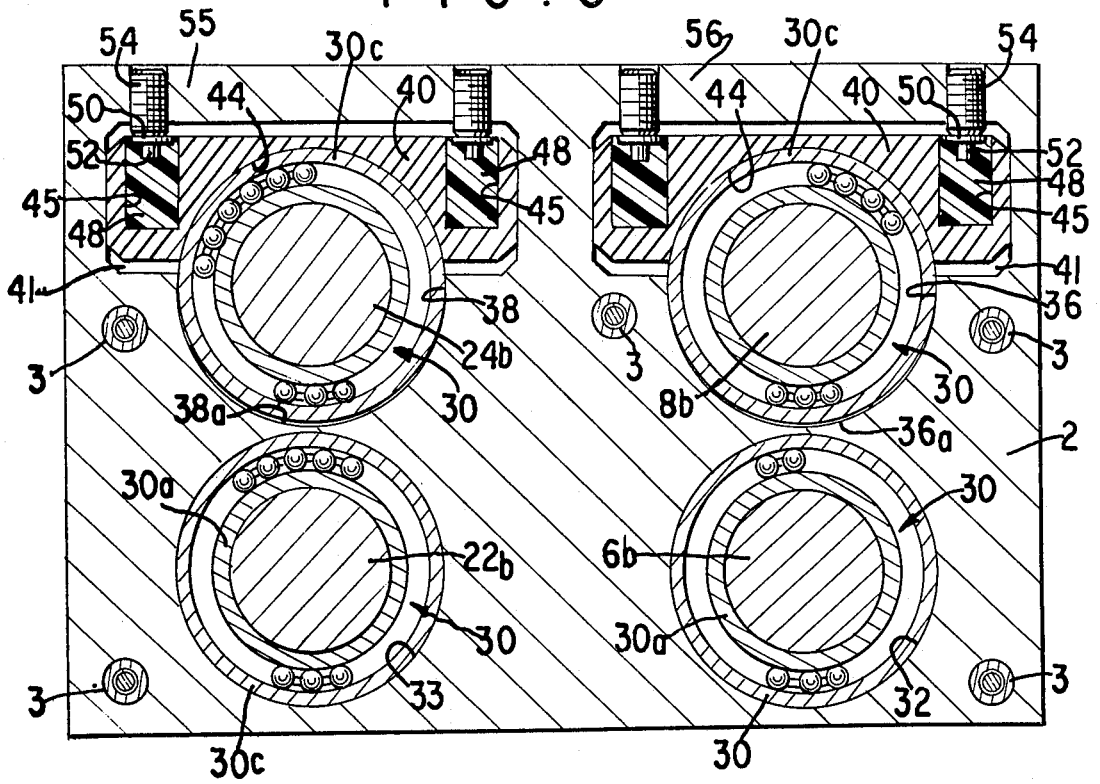
FIG. 3 is a vertical sectional view taken on line 3—3 of FIG. 2, showing parts of the end frame and bearings along one side of the apparatus.

Each of the four rollers has on its opposite ends trunnions mounting the roller for rotation in respective antifriction bearing units, such as radial ball bearing rings 30, which are seated in respective recesses formed in the upright end frames of the apparatus. For instance, trunnions 6*a* and 6*b* on the ends of the lower feed roller 6 are fitted into the inner races 30*a* of bearing units 30 seated, respectively, in recesses 31 and 32 of the frames 1 and 2. The lower pressure roller 22 is mounted similarly, the ball bearing unit 30 on its trunnion 22*b* being seated in recess 33 of frame 2 as seen in FIG. 3. The outer races 30*c* of the bearings of the lower roller of each set are seated solidly in the respective frame recesses, so that these bearings will directly sustain the radial force exerted on the lower roller by the peripheral surface of the upper roller of the same roller set.

Figure 2:
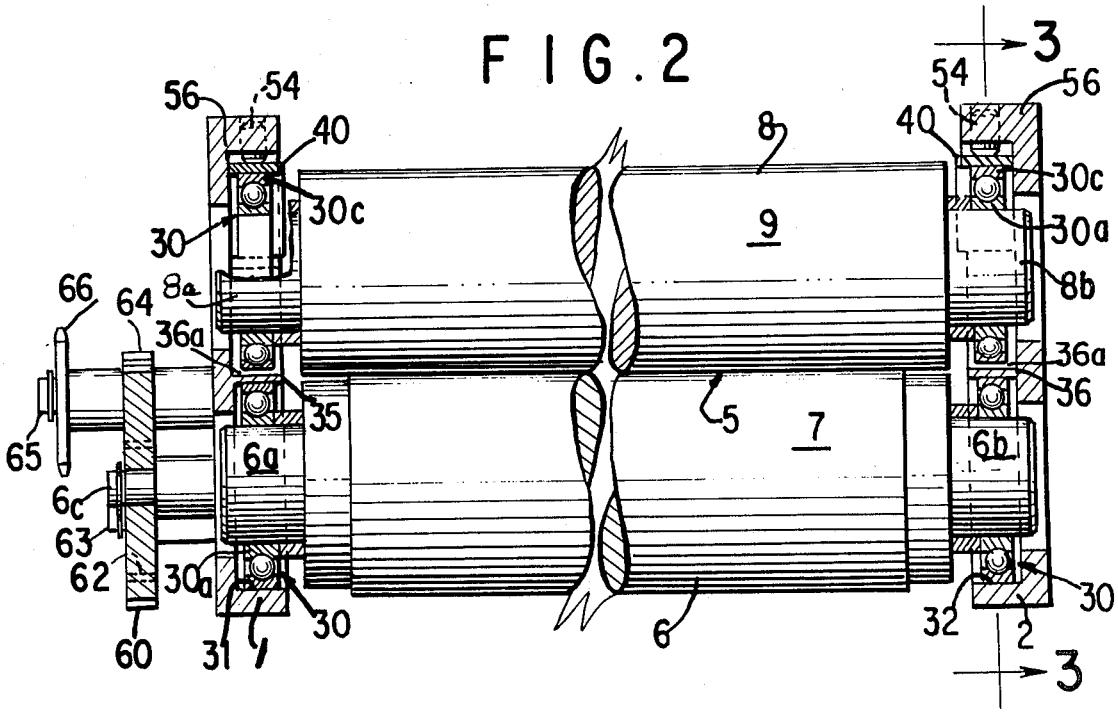
FIG. 2 is a transverse vertical sectional view taken substantially on line 2—2 of FIG. 1.

The upper roller of each set has its journals supported, similarly as the lower roller, in radial ball bearing units 30 seated in recesses in the end frames. FIGS. 2 and 3 show the trunnions 8*a* and 8*b* of feed roller 8 supported in the inner races 30*a* of bearings 30 which are mounted in frame recesses 35 and 36. FIG. 3 also shows the trunnion 24*b* of upper pressure roller 24 supported in its bearing 30 seated in a recess 38 in frame 2, the other trunnion 24*a* of this roller being similarly mounted in frame 1.

The outer race 30*c* of each end bearing of each upper roller, however, is not seated solidly in the related frame recess. Instead, the recesses receiving these bearings are each enlarged sufficiently in a lower portion thereof, such as in the lower hemi-cylindrical regions 36*a* and 38*a* of recesses 36 and 38, so that each upper roller is free of constraint in downward direction otherwise than by the engagement of its peripheral surface 9 or 25 with the peripheral surface 7 or 23 of the lower roller of its set.

Consequently, any force applied downwardly upon the upper pressure roller 24, or upon the upper feed roller 8, is translated directly into a pressure between the peripheral surface of this roller and that of the related lower roller along the narrow line of their coengagement in the nip 5 or 20.

The pressure required in either of these nips for properly processing a given sheet material carrying an image of a given toner is produced by means of a pressure distributing block 40 and related force applying structures acting on the bearing at each end of each upper roller 8 or 24.

Each pressure distribution block 40 is a rigid metal block extending transversely over the related end bearing 30 of the roller and formed along its lower side with a concave surface 44 seated upon the outer race 40*c* of the bearing. Each block fits into a frame recess 41 that is wider than the block in vertical direction, so that the block is free to be displaced vertically relative to the related end frame.

The opposite end portions of each block 40, at either side of its bearing surface 44 (See FIG. 3), are each formed with an upwardly open chamber 45, or pocket, in each of which a body 48 of an elastomeric material, such, for example, as urethane rubber, is confined by the wall of the pocket. A pressure applying member 50, which may be a washer ring fitted on a stem 52, bears against the upper end of each of the confined elastomeric bodies 48. Each of these pressure applying members is positioned adjustably relative to the related elastomeric body by an adjustably settable thrusting means, such as a pressure locking screw 54, mounted in a top portion 55 or 56 of the related frame 1 or 2 above the related block 44.

It will be evident that by adjustments of the position and thrusts of the two pressure applying members 50 of each block 40, the elastomeric bodies 48 confined in the pockets of the block can be caused to build up a force of any desired magnitude sustainable by the strength of the structures used, and to apply this force constantly through the block and the related end bearing of the upper roller 24 or 8 at the nip between the peripheral surface of this roller and the coengaging lower roller surface. The adjustments can be effected readily by movement of the pressure locking screws 54, which are accessible from the top side of the end frames 1 and 2. The range of forces that can be thus applied through each end of each upper roller extends, for instance, from a value as low as only a few pounds up to a value as high as about 3400 pounds.

Accordingly, the pressure rollers 22 and 24 may readily be set under a force effective in the manner above described to fix the softened toner images on sheets passed through them from the heating zone 10, and the feed rollers 6 and 8 may readily be set under the force desired for feeding each sheet into and through the heating zone at a constant speed. For example, for effectively fixing images of a preferred "one-component" developing powder on photoconductive paper sheets in an apparatus in which the hard roller surfaces form a nip 9.5 inches long, the pressure block on each end bearing of the upper pressure roller 24 may be set advantageously under a downward force of about 700 to 900 pounds, while the pressure block on each end of the upper feed roller 8 may be set under a downward force of about 200 to 300 pounds.

Figure 4:
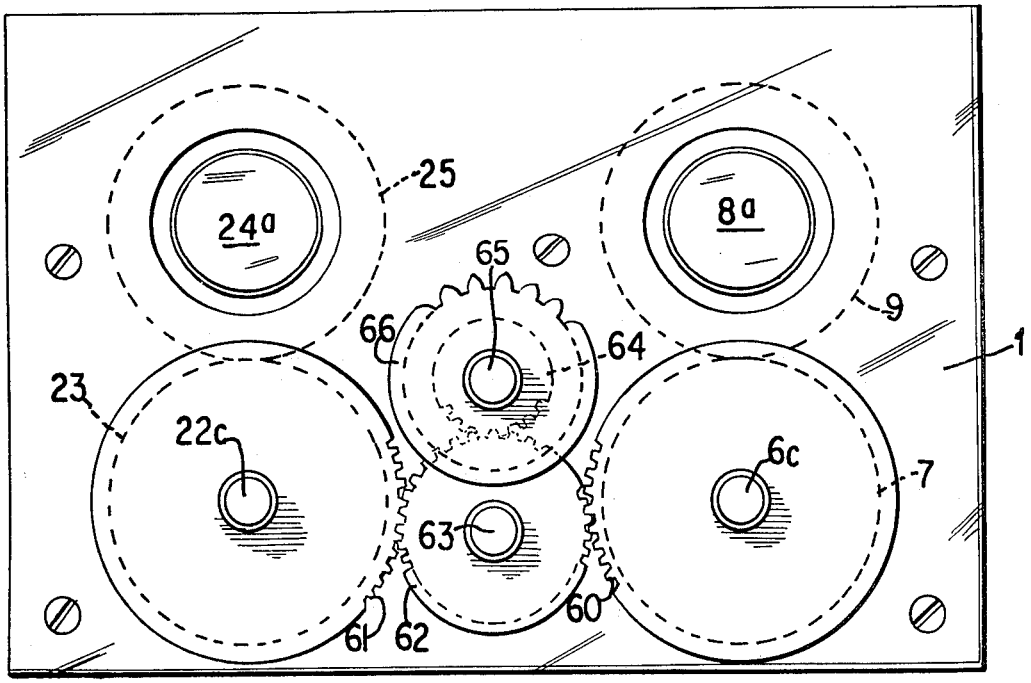
FIG. 4 is an end elevational view of the driving gears shown at the left-hand side of FIG. 2.

The two rollers of each set rotate together at the same speed by reason of their coengagement under pressure along nip 5 or 20. The feed rollers are rotated at a substantially constant speed, by suitable drive transmission means interconnecting the lower feed roller 6 and the lower pressure roller 22. In the embodiment shown (see FIG. 4), these lower rollers have stub shafts 6*c* and 22*c* on their respective trunnions mounted in frame 1. The stub shafts extend outside the frame and carry respective gear wheels 60 and 61 which are rotated together by a common spur gear 62. The spur gear rotates on a fixed shaft 63 and is driven by a pinion 64 fixed to a rotary shaft 65 having a driving sprocket 66 thereon. A driven chain engaging sprocket 66 drives the transmission gears at the speed required for the use to be made of the fixing apparatus.

The upper pressure roller 22 and the upper feed roller 8 each has a wiping pad 70 pressed against its peripheral surface at a location along its backward side away from the nip 5 or 20. Each pad 70 may be composed, for example, of a felt material and may be mounted removably on one of the frame connecting rods 3. The pad 70 wipes off any toner particles that may be present on the roller surface after it has pressed against the image in the nip, so that the roller surface entering the nip is at all times smooth and even.

We claim:

1. Apparatus for fixing an image of fusible toner particles on flexible sheet material, comprising upright frames spaced apart at opposite side of the apparatus and defining a fixing zone therebetween, means for feeding said material with said image thereon into said zone at a substantially constant speed, two pressure rollers having coengaging smooth rigid peripheral surfaces pressed and rotated together, one over and upon the other, for engaging and advancing said material therebetween as said material passes said zone, means for rotating said rollers at a peripheral speed equal to said feeding speed, and means for constantly pressing each end of the upper of said rollers against the adjacent end of the lower of them under a selected force of between about 20 and about 3400 pounds per inch of length of the nip between said roller surfaces, said force being sufficiently great to join the toner particles superficially to one another and to the surface structure of said material by pressure as said material is advanced between said surfaces, each of said rollers having on its ends journals rotatable in respective surrounding anti-friction bearing units seated in respective recesses in said frames, each said bearing unit of the upper roller having a non-rotary outer bearing race that is free of constraint in downward direction otherwise than by the coengaging rigid peripheral surfaces of said rollers, a rigid pressure distributing block extending transversely over and seated on each said outer bearing race, each said block being displaceable vertically in a recess in one of said frames and having in each of its opposite end portions an upwardly open pocket containing a confined body of elastomeric material, a pressure member bearing downward upon each said elastomeric body, and adjustably settable means mounted in upper portions of said frames for holding each said pressure member pressed under a selected force against the related elastomeric body.

2. Apparatus for fixing an image of fusible toner particles on flexible sheet material, comprising walls defining a fixing zone therebetween, means for feeding said material with said image thereon into said zone at a substantially constant speed, two pressure rollers having coengaging smooth rigid peripheral surfaces pressed and rotated together for engaging and advancing said material therebetween as said material passes through said zone, means for rotating said rollers at a peripheral speed equal to said feeding speed, and means for constantly pressing each end of one of said rollers against the adjacent end of the other of them under a selected force of between about 20 and about 3400 pounds per inch of length of the nip between said roller surfaces, said force being sufficiently great to join the toner particles superficially to one another and to the surface structure of said material by pressure as said material is advanced between said surfaces, said walls including upright frames spaced apart at opposite sides of the apparatus, said feeding means comprising two feed rollers having coengaging smooth rigid peripheral surfaces for engaging and advancing said material therebetween, each set of said two rollers having one roller thereof disposed over and constantly pressing downwardly upon the other roller thereof, each of the said rollers having on its ends journals rotatable in respective surrounding anti-friction bearing units seated in respective recesses in said frames, each said bearing unit of the upper roller of each said set having a non-rotary outer bearing race that is free of constraint in downward direction otherwise than by the coengaging rigid peripheral surfaces of the roller set, a rigid pressure distributing block extending transversely over and seated on each said outer bearing race, each said block being displaceable vertically in a recess in one of said frames and having in each of its opposite end portions an upwardly open pocket containing a confined body of elastomeric material, a pressure member bearing downward upon each said elastomeric body, and adjustably settable means for holding each said pressure member pressed under a selected force against the related elastomeric body, said settable means being mounted in upper portions of said frames.

3. Apparatus according to claim 2, and drive transmission means interconnecting the lower of said feed rollers and the lower of said pressure rollers for rotating said rollers at a constant peripheral speed.

4. Apparatus according to claim 2, the peripheral surface of each of said rollers being a polished hardened steel surface.

5. Apparatus according to claim 2, said walls further including a substantially horizontal guide plate over which said material slides image-side-up between said feed rollers and said pressure rollers and a roof partition spaced above said guide plate, and heating means comprising a radiant heating device in the space between said plate and said partition, said roof partition having a heat reflective lower surface that reflects radiation incident thereto back toward said plate.

* * * * *